US005078828A

United States Patent [19]

Marglin

[11] Patent Number: 5,078,828

[45] Date of Patent: Jan. 7, 1992

[54] FILM PATCH, JIG AND METHOD OF USING SAME

[75] Inventor: Andrew J. Marglin, Lloyd Neck, N.Y.

[73] Assignee: Kelmar Systems, Inc., Huntington Station, N.Y.

[21] Appl. No.: 462,610

[22] Filed: Jan. 9, 1990

[51] Int. Cl.[5] ..... B31F 5/06; B42D 15/00

[52] U.S. Cl. ..... 156/505; 156/304.1; 156/502; 428/41; 283/81; 283/92; 283/100; 283/101

[58] Field of Search ..... 156/304.1, 502, 505, 156/506; 283/81, 91, 92, 100, 101; 428/41

[56] References Cited

U.S. PATENT DOCUMENTS

| | | | |
|---|---|---|---|
| 2,994,362 | 8/1961 | Hall | 156/505 |
| 3,290,201 | 12/1966 | Jorgensen | 156/505 |
| 3,475,263 | 10/1969 | Kapilow et al. | 156/505 X |
| 3,716,444 | 2/1973 | Hanke | 156/505 |
| 3,764,440 | 10/1973 | Schroter et al. | 156/505 |
| 3,802,983 | 4/1974 | Epperson et al. | 156/502 X |
| 3,854,229 | 12/1974 | Morgan | 283/101 X |
| 3,914,491 | 10/1975 | Talahashi | 428/137 |
| 4,055,453 | 10/1977 | Tajima et al. | 428/41 X |
| 4,663,518 | 5/1987 | Borror et al. | 283/91 X |
| 4,856,820 | 8/1989 | Kasprzak et al. | 283/81 |
| 4,891,505 | 1/1990 | Jalon | 283/92 X |
| 4,927,179 | 5/1990 | Ehret et al. | 283/81 X |

*Primary Examiner*—William A. Powell
*Assistant Examiner*—J. Sells
*Attorney, Agent, or Firm*—Amster, Rothstein & Ebenstein

[57] ABSTRACT

The present invention relates to a patch which is easily applied to motion picture film, a jig and a method for using the same. The patch may act as a splice to connect two lengths of film which require repair or which must be joined together to produce a complete presentation. The patch may also be applied along a predetermined position of the film to carry control information which may be used to control the sequence of events in a movie theater. In some applications, the patch may serve both a splicing as well as an information-carrying function. The patch can be rapidly and accurately positioned and attached to the film by use of a novel splicing jig and results in a splice which does not leave any adhesive residue about the film sprocket holes or on the jig.

24 Claims, 5 Drawing Sheets

Fig. 5.
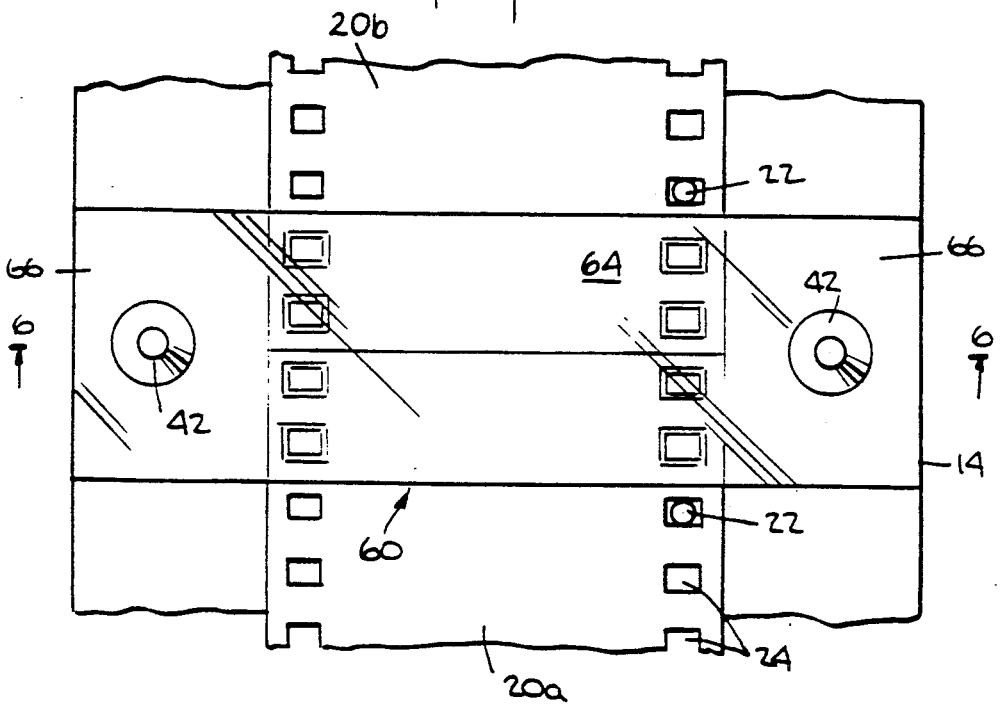
Fig. 6.
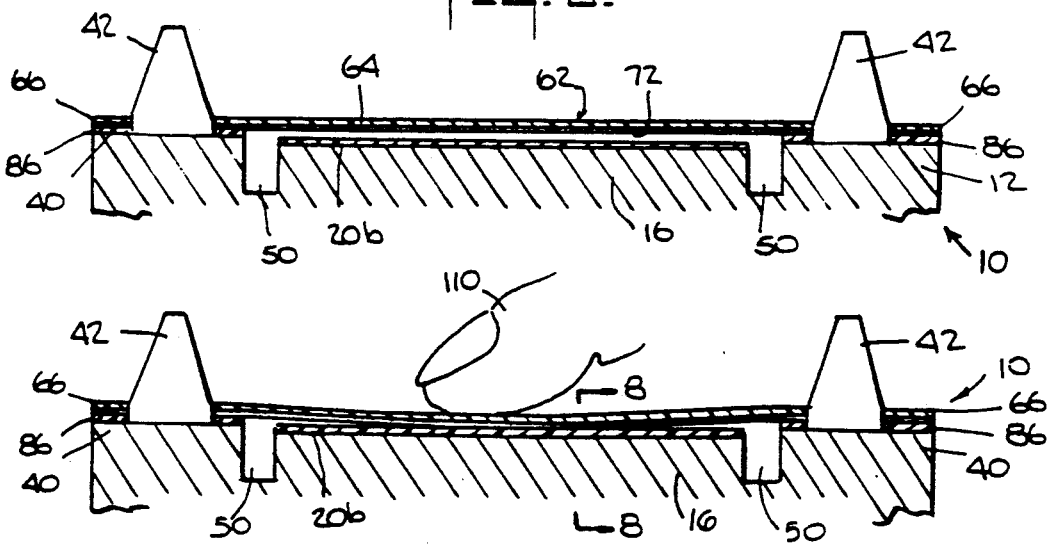
Fig. 7.
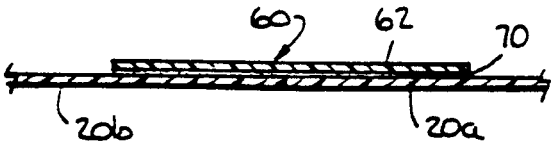
Fig. 8.

Fig. 9.
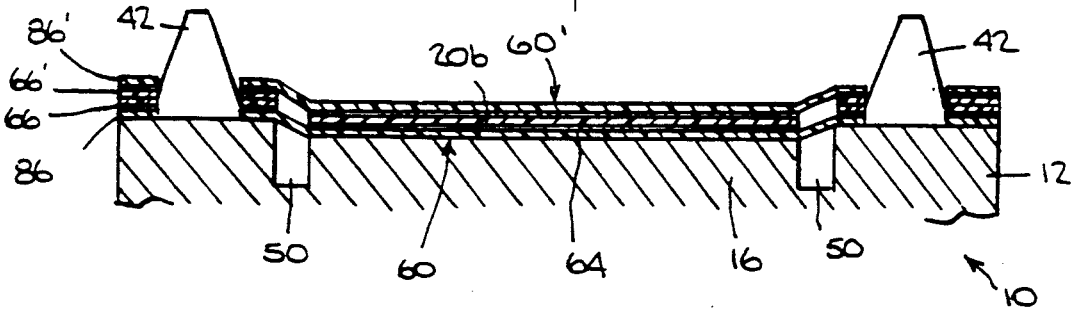
Fig. 10.
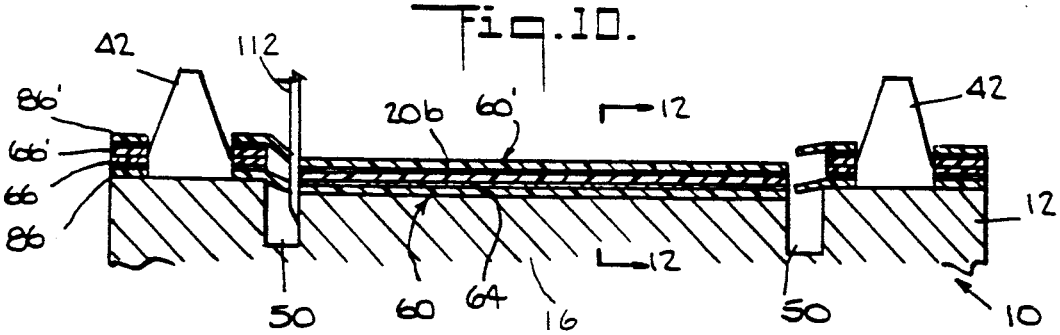
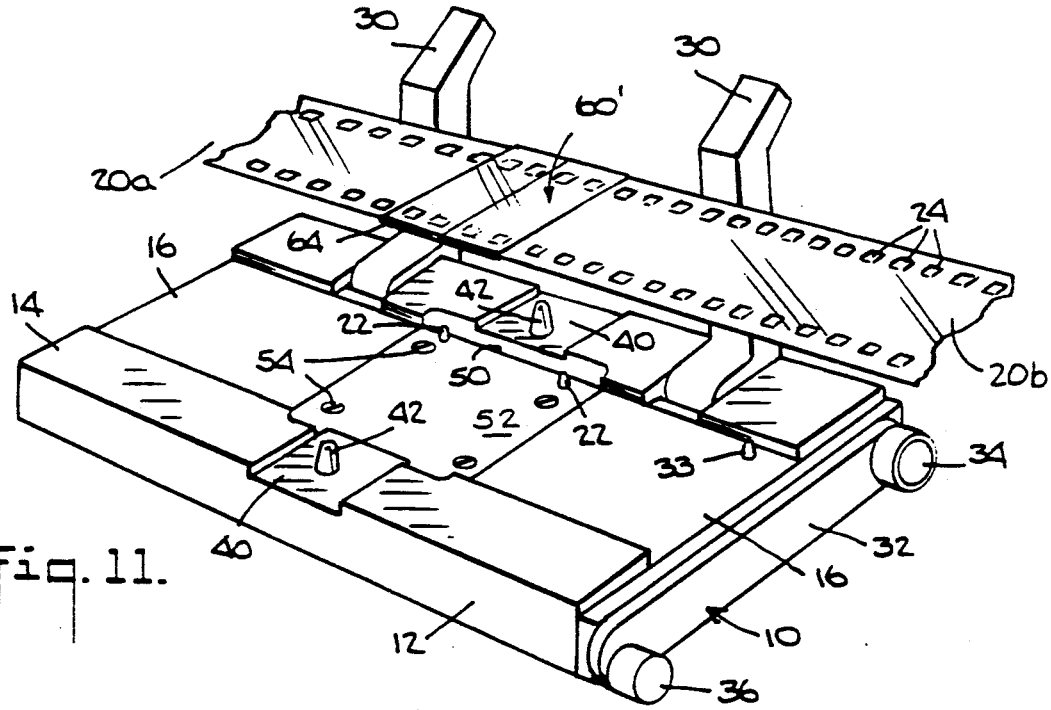
Fig. 11.
Fig. 12.
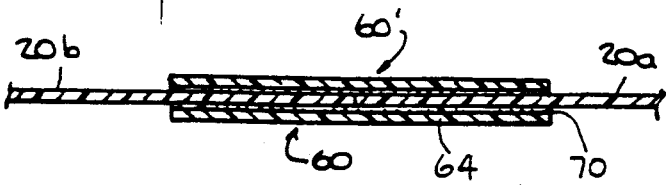

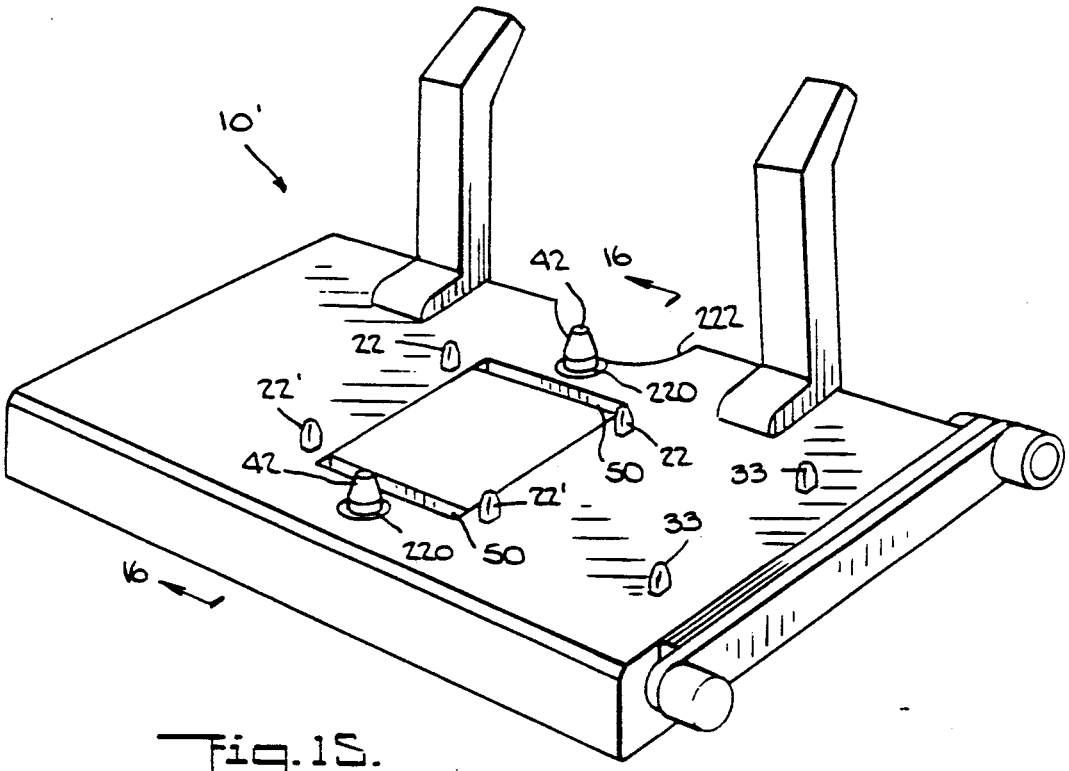
Fig. 15.
Fig. 16.
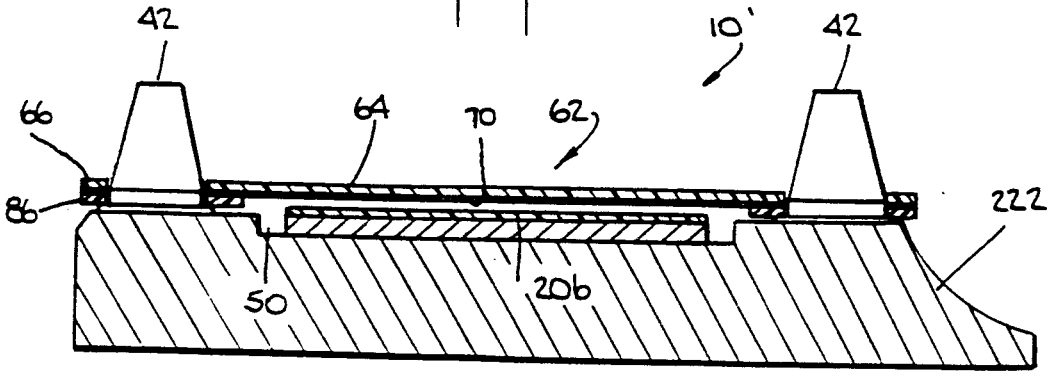

FILM PATCH, JIG AND METHOD OF USING SAME

BACKGROUND OF THE INVENTION

The present invention relates to motion picture film and in particularly to a film patch therefor, a jig for applying the same to the film, and a method of using the same. The film patch can splice two ends of the film together and/or contain control information such that the patch can be readily located wherever inserted on the film and used to control functions associated with film viewing.

Advances in movie theater technology, and in particular changes in the film delivery method used in transporting film to and from the projector, have resulted in the need, first, to perform accurately and rapidly many splicing operations and, second, to locate rapidly the positions of the splices. Historically, commercial movie film has been distributed to theaters on reels which each contain about 1800 feet of film length. Each reel of film typically has a 20 foot leader section and a 20 foot trailer section, which respectively precede and follow the commercial film content. Since a standard 35 mm motion picture projector transports film at a linear rate of 90 feet per minute, each reel only provides approximately 20 minutes of viewing time. Accordingly, a commercial feature film may consist of up to six or more separate reels of film. In the past, theater projection rooms were equipped with two reel-to-reel projectors so that the film reels could be shown in sequence on alternate projectors without interruption. The rapid "changeover" between projectors was performed by a projectionist stationed in each projection room, who responded to visual cues displayed on the screen. The projectionist also attended to the preparation of each projector for its next use.

As theaters became automated, a new film delivery system was developed which provides for longer unattended playing time. In this system, widely used today in most modern theaters the film is placed on a horizontal-stacked tier containing several large "servo-driven" platters, each platter being approximately 52 inches in diameter. However, commercial film continues to be distributed on reels which only hold 1800 feet of film. In order to convert the reel film for use in the platter delivery system, the reel film is first prepared by removing from the program material all of the leader and trailer material on each reel of film as shipped, and then splicing the program material together so that it forms one continuous length of film. Complementary materials, such as "coming attractions," are also added at appropriate positions to this single length of film which now contains the entire theater presentation on one 11,000–12,000 foot length of film. Thus a projectionist is not required for each projection booth, at least not on a full-time basis (as would be the case if the projectionist had to change film reels on a frequent basis).

When the movie theater is finished with the film, the entire process must be reversed prior to returning the film to the distributor. The individual splices between each of the original film reels must be located and removed, and the leaders and trailers must be spliced back into their original positions. Since the splice material which overlays the film must be transparent, locating the splices along the 11,000–12,000 foot film length is a tedious and time consuming operation. To facilitate the location of the splices, many theater operators utilize a yellow tape having black stripes (known as "zebra tape") to mark the location of the splices. The presence of the zebra tape often interferes with the soundtrack and may also be visibly noticeable on the screen as it passes through the projector during the film presentation.

Prior art splicing techniques utilized in the commercial theater industry are not entirely satisfactory. In one technique, the film is placed on a splicing jig having four upstanding alignment pins, with the film sprocket holes registering with and being entered by the alignment pins, and a roll of transparent tape dimensioned to the film and having apertures corresponding to the film sprocket holes is then manually overlaid onto the film and alignment pins to form the splice. However, the tape must be delicately handled so that it simultaneously is registered onto the four alignment pins and placed in contact with the film. This technique tends to result in splices which have creases in the tape and entrapped air pockets. Another commonly used prior art technique was developed in Europe approximately twenty five years ago and is generally known as the "guillotine splicer". In this technique, the film is placed on a jig containing a die set. A roll of clear tape, having no perforations, is laid across the film and the dies used to punch holes in the tape in alignment with the sprocket holes of the film. The excess tape is finally sheared off from the film edges. However, after a month or so of use, the adhesive residues of the tape cause the die sets to become gummed up and the cutter knives to lose their edges. Often the perforations are not punched through completely, thus leading to misfeeding of the film through the projector.

Thus, the need remains for a film splicing technique enabling film to be accurately and rapidly spliced without gumming up of either the jig or the film sprocket holes with adhesive residues from the splicing patch, without creasing of the splicing patch or the formation of air pockets between the patch and the film, and optionally with means provided to enable the splice to be easily located for removal thereof (so that the film can be returned to separate reels) without being visibly noticeable during projection of the film or interfering with the functioning of the sound track.

The modern trend is to use either no full-time projectionist at all or a single projectionist for a plurality of different projection booths, so that the projectionist is not always available in a given projection booth to perform the various control functions or sequence of events which may be required in a theater—such as dimming or raising of the lights, raising or lowering a curtain, changing projection lenses, and the like. These functions or events are typically keyed to particular times during the projection of a film and hence to particular segments or frames of the film. Thus, there is a need for a control patch, somewhat similar to a splicing patch, which would be automatically detectable during projection of the film and enable the various control functions identified by the particular control patches to be automatically performed as the control patches pass through the projector. Such a control patch might be placed on the film either at the local movie theatre or by the distributor, the control strip having no effect in those local theatres of a distributor which are not equipped to utilize the same, but enabling the desired functions to be performed automatically (and even in the absence of a projectionist) in suitably equipped local theatres. Preferably, the control patch would contain the same information or data both in human-intelligible form and in machine-readable form, with both forms being so disposed on the control patch that they are not projected onto the screen by the projector light beam yet are visible to the projectionist and/or control machine under appropriate special lighting.

Accordingly, it is an object of the present invention to provide a film patch which can be used as a splicing patch to splice film and as a control patch to provide information which can be used to perform various control functions. As used herein, the term film patch shall mean either a splicing patch or a control patch.

It is another object of the invention to provide a film patch which is rapidly and accurately applicable to motion picture film without creasing of the patch, without the formation of air bubbles intermediate the patch and the film, and without introducing adhesive residue into the film sprocket holes or onto the jig.

Another object is to provide such a film patch which does not manifest itself on the screen or by interference with the soundtrack, but which manifests its location on the film under special conditions so that it can be easily and rapidly detected to facilitate removal of the patch from the film at a suitable time.

A further object is to provide a film patch containing machine-readable information for control functions readable under special conditions but ordinarily transparent to light within the visible range.

It is also an object to provide such a film patch which contains related information in human-intelligible form readable under special conditions but ordinarily transparent to light within the visible range.

It is another object to provide a jig for use in applying such a patch to a film.

It is a further object to provide a method of splicing utilizing such a jig and patch.

SUMMARY OF THE INVENTION

It has now been found that the above and related objects are obtained in the present invention which comprises a film patch for attachment to film—for example to splice two film segments held in end-to-end abutting relationship in a jig —the jig, and the method of applying the film patch. In an embodiment of the present invention, the film patch includes control information. Further, the present invention comprises the combination of a motion picture film and a film patch adhered thereto.

In one embodiment of the invention, the film patch is adapted to attach together two film segments held in end-to-end abutting relationship in a splicer jig and having sprocket holes longitudinally spaced along at least one longitudinal edge thereof. The patch comprises a strip of transparent material having a central portion and an edge portion on each side of the strip central portion, a layer of transparent pressure-sensitive adhesive extending across the undersurface of the strip central portion, and a releasable liner adhered to and covering the undersurface of the adhesive layer. The strip central portion is configured and dimensioned to overlie the width of both film segments, and each of the strip edge portions is configured and dimensioned to extend widthwise beyond a respective longitudinal edge of both film segments, when the strip overlies the film. The strip central portion has longitudinally spaced sprocket holes aligned with the film sprocket holes, and each strip edge portion has an alignment aperture therein for accurately positioning the strip across the film segments in the jig to effect vertical alignment of the strip sprocket holes and the film sprocket holes.

In a preferred embodiment of the film patch, the alignment apertures are laterally aligned, and the strip is flexible, substantially non-stretchable along the longitudinal axis, and slightly stretchable along the width axis. The liner has a releasable central portion and an edge portion on each side thereof, the liner central portion having longitudinally spaced sprocket holes aligned with the strip central portion sprocket holes. The strip and liner sprocket holes are greater in length and width than the film sprocket holes.

Preferably, the adhesive layer extends fully across the undersurface of the strip, and the liner has a releasable central portion and an edge portion on each side of the liner central portion, each liner edge portion having an alignment aperture therein aligned with a respective strip alignment aperture. The liner additionally defines a line of severance intermediate the liner central portion and each of the liner edge portions, and most preferably the liner central portion and the liner edge portions are three individual and separate pieces.

The portion of the patch remaining after release and removal of the liner and removal of the strip edge portions, and preferably the adhesive layer, may contain indicia transparent to ordinary light but detectable by other means, for example, a fluorescent dye visible to the human eye under infrared or ultraviolet light.

The patch may be adapted to also serve as a control strip by the strip central portion additionally including a first material which is transparent under ordinary light but detectable by other means such as being visible under a first special light or magnetically readable. At least a portion of the first material is preferably arranged to provide information or data relative to one of the film segments, typically in machine-readable form and machine-readable under the first special light. The releasable liner may include indicia visible under ordinary light related to the information or data provided on the patch by the first material. At least a portion of the first material is optionally a fluorescent dye incorporated into the adhesive layer.

The patch may additionally include a second material which is also transparent under ordinary light but detectable by other means such as being readable under a second special light or magnetically readable. Preferably at least a portion of the first material is arranged to provide information or data relative to one of the film segments, and at least a portion of the second material is arranged to provide information or data related to the information or data on the information- or data-providing portion of the first material. The information or data-providing portion of the first material is in machine-readable form, and the information or data-providing portion of the second material is in human-intelligible form. The second material is different from the first material and is, for example, visible to the human eye under a second special light which is different from the first special light, the first material being transparent (i.e., non-visible) to the human eye in the second special light and the second material being transparent (i.e., non-visible) to the reading machine in the first special light. At least one of the strip edge portions may contain indicia visible under ordinary light for providing information or data related to the information or data provided by the first material.

The jig for use in applying a film patch to a film for joining film segments thereof or otherwise comprises a housing and means, including a longitudinally spaced pair of sprocket lugs upstanding from the housing. When used for splicing, the housing receives a pair of film segments to be spliced together in end-to-end abutting relationship and maintains the film segments in such end-to-end abutting relationship when appropriate sprocket holes of the film segments are placed on respective sprocket lugs. A laterally spaced pair of tensioning lugs is upstanding from the housing, each disposed laterally to a respective side of the sprocket lugs and laterally outwardly of the film segments, for normally holding an unstretched film patch in close proximity to but spaced above the film segments to be spliced.

In a preferred embodiment, the housing defines, adjacent to and laterally inwardly of each of the tensioning lugs, a longitudinally extending groove extending to a depth below the film segments for facilitating severance of a central portion of a film patch from a longitudinal edge portion thereof along a predetermined line without cutting of the adjacent longitudinal film edge. Each of the tensioning lugs extends further outwardly at the bottom thereof than at the top thereof, and is preferably conical in configuration. The tensioning lugs are disposed longitudinally intermediate the pair of sprocket lugs, the pair of tensioning lugs being transversely aligned and the pair of sprocket lugs being longitudinally aligned.

In a first embodiment of the jig the receiving and maintaining means comprises an open-topped channel in the housing for receiving a pair of film segments to be spliced together in end-to-end abutting relationship and a longitudinally spaced pair of sprocket lugs upstanding from the channel for maintaining the film segments in such end-to-end abutting relationship when an appropriate sprocket hole of a film segment is placed on a respective sprocket lug. The laterally spaced pair of tensioning lugs is disposed one tensioning lug to either side of the channel. The housing defines, adjacent to and laterally inwardly of each of the tensioning lugs, a longitudinally extending groove extending to a depth below the film segments for facilitating severance of a central portion of a film patch from a longitudinal edge portion thereof along a predetermined line without cutting of the adjacent longitudinal film edge.

In a second embodiment of the jig suitable for joining film segments having each a transversely spaced pair of longitudinally spaced pluralities of sprocket holes, the receiving and maintaining means comprises a transversely spaced pair of the longitudinally spaced pair of sprocket lugs. The housing optionally upper surface is generally planar, except for the grooves, the sprocket lugs and the tensioning lugs, and the housing optionally defines laterally outwardly of at least one of the tensioning lugs a cut-away to facilitate lifting of an overlying portion of the film patch. The tensioning lugs are generally conical in configuration, but with a flared base adjacent the housing and are configured and dimensioned for normally maintaining an unstretched film patch in close promimity to but above the film segments to be spliced.

The method of splicing two film segments together, each film segment containing along at least one edge thereof a plurality of longitudinally spaced sprocket holes, comprises the steps of inserting the film segments into the jig with the jig sprocket lugs entering into the film sprocket holes and maintaining the adjacent ends of the film segments to be spliced in end-to-end abutting relationship. The film patch is then placed on the jig over the adjacent ends of the film segments, with the jig aligning and tensioning lugs entering into the patch aligning and tensioning holes to vertically align the patch sprocket holes with the film sprocket holes and maintain the patch central portion in close proximity to but normally slightly spaced above the film segments. Downward pressure is exerted on the patch central portion overlying the film segments to cause the patch adhesive layer to adhere to the film segments and thereby effect a splice of the film segments.

Then the patch central portion overlying the film segments is separated from the patch edge portions extending beyond the spliced film segments, and the spliced film segments including the patch central portion are removed from the jig.

In a preferred embodiment of the method, the patch initially has a release liner disposed on the undersurface of the patch adhesive layer and only a central portion of the release liner is removed from the patch prior to placement of the patch on the jig, so as to expose the undersurface of the patch adhesive layer to the film segments. The longitudinal extent of the patch is placed on the jig intermediate a pair of adjacent jig sprocket lugs. The exertion of downward pressure on the patch central portion slightly stretches the strip along its width.

Preferably, prior to the separation step, the spliced film segments are turned over, and a new patch applied to the other side of the film so that subsequently both patch central portions are separated from their respective patch edge portions and the spliced film segments removed from the jig include both patch central portions.

In the combination of a motion picture film and a film patch adhered thereto, the film patch comprises a transparent strip having a transparent pressure-sensitive adhesive on one side thereof adhering the transparent strip to a length of the film. The film patch additionally includes at least a first material which is transparent under ordinary light but detectable by other means such as being visible under a first special light. Preferably, the film patch is imperforate and dimensioned to fit between the longitudinal rows of the film sprocket holes.

BRIEF DESCRIPTION OF THE DRAWING

The above brief description, as well as further objects and features of present invention, will be more fully understood by reference to the following detail description of the presently preferred, albeit illustrative, embodiments of the present invention when taken in conjunction with the accompanying drawing wherein:

FIG. 5 is a fragmentary top plan view of the jig of the present invention, the film and a portion of the film patch held in position by the jig;

FIG. 6 is a fragmentary sectional view thereof taken along the line 6—6 of FIG. 5;

FIG. 7 is a fragmentary sectional view similar to FIG. 6, but showing the central portion of the film patch being depressed by a finger onto the film;

FIG. 8 is a fragmentary sectional view, taken along the line 8—8 of FIG. 7, of an assembly composite of the film and the portion of the film patch applied thereto, removed from the jig;

FIG. 9 is a fragmentary sectional view similar to FIG. 7 after the assembly composite has been returned to the jig in the inverted position and a portion of a second film patch applied thereto;

FIG. 10 is a fragmentary sectional view showing on the left side a knife cutting the film patch edge portions of both patches from the patch central portions and film (such cutting already having been performed on the right side thereof);

FIG. 11 is a fragmentary isometric view of the spliced film segments being removed from the jig;

FIG. 12 is a fragmentary sectional view, taken along the line 12—12 of FIG. 10, of the spliced film segments;

FIG. 15 is an isometric view of a second embodiment of a jig according to the present invention; and FIG. 16 is a fragmentary sectional view, taken along the line 16—16 of FIG. 15, of the jig, a film segment in the jig and a patch held by the jig above the film segment.

DETAILED DESCRIPTION OF THE PREFERRED EMBODIMENTS

Figure 1:
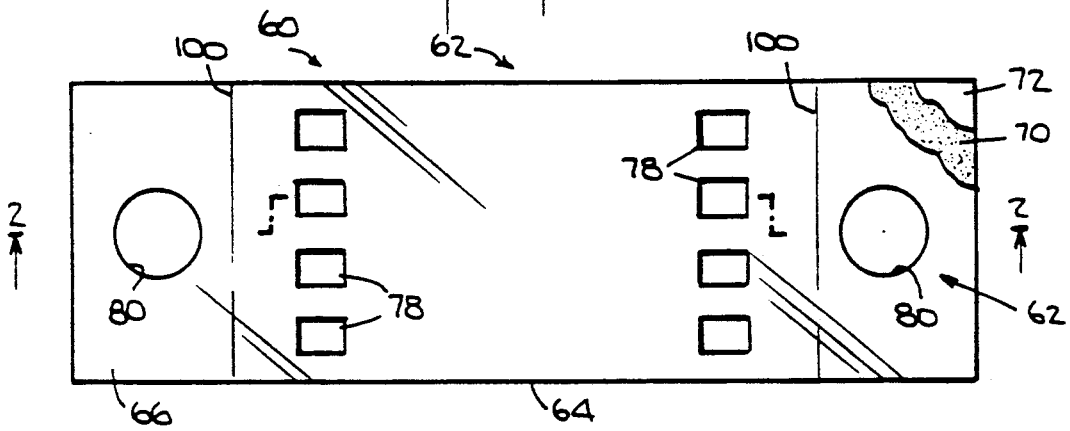
FIG. 1 is a top plan view of a film patch according to the present invention.

Referring now to the drawing and in particular to FIGS. 3-7 and 9-11, therein illustrated is a splicer jig generally designated by the reference numeral 10 according to the present invention. The jig 10 is similar to conventional splicing jigs in that it comprises a generally rectangular body or housing 12 having a front or top face 14 defining a longitudinally extending channel 16 for the full length thereof, the channel 16 being configured and dimensioned to receive and maintain therewithin below the plane of the front face 14 two film segments 20*a* and 20*b* longitudinally aligned in an end-to-end abutting relationship appropriate for splicing thereof.

Figure 3:
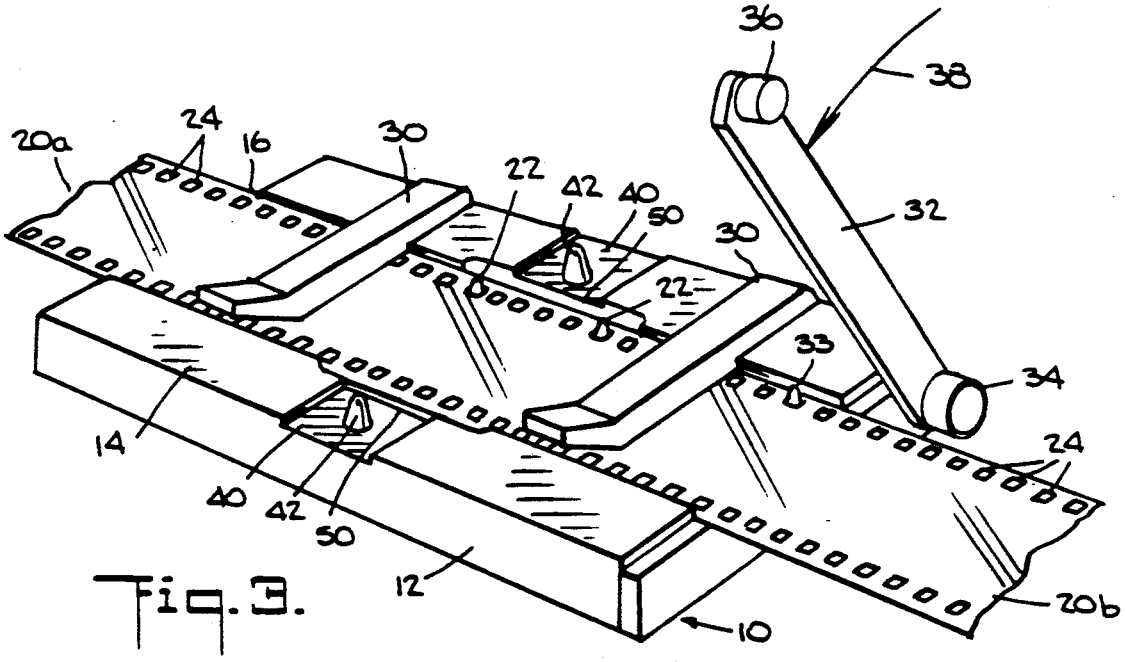
FIG. 3 is a fragmentary isometric view of two film segments held in end-to-end abutting relationship according to the present invention by a jig, ready for splicing.

As is conventional, projecting upwardly from the longitudinal channel 16 are at least two longitudinally spaced and aligned sprocket lugs 22, one sprocket lug 22 being adapted to enter a properly positioned sprocket hole 24 of the film segment 20*a* and the other sprocket lug 22 being adapted to enter a properly positioned sprocket hole 24 of the other film segment 20*b* as best seen in FIG. 3. The sprocket lugs 22 and film sprocket holes 24 cooperate to insure appropriate longitudinal spacing of the film segments 20*a* and 20*b* and hence to insure appropriate longitudinal spacing of the adjacent sprocket holes 24 of the adjacent film segment ends. While the jig 10 is illustrated as having two sprocket lugs 22 longitudinally aligned, all along one longitudinal edge of the film segments 20*a*, 20*b*, clearly one or more of these sprocket lugs 22 or additional sprocket lugs 22 may be disposed along the other longitudinal edge of the film segments 20*a*, 20*b* and there need be only one sprocket lug 22 per film segment 20*a* or 20*b*.

As is also conventional, the jig contains film retaining means such as a pair of longitudinally spaced pivotable lever arms 30 which may be swung upwardly to permit placement of film segments 20*a*, 20*b* in the channel 16 (as in FIG. 4) or removal of the film segments therefrom (as in FIG. 11), or swung downwardly to retain the film segments in appropriate position within the channel 16 once the sprocket lugs 22 have entered the film sprocket holes 24 (as in FIG. 3).

Figure 4:
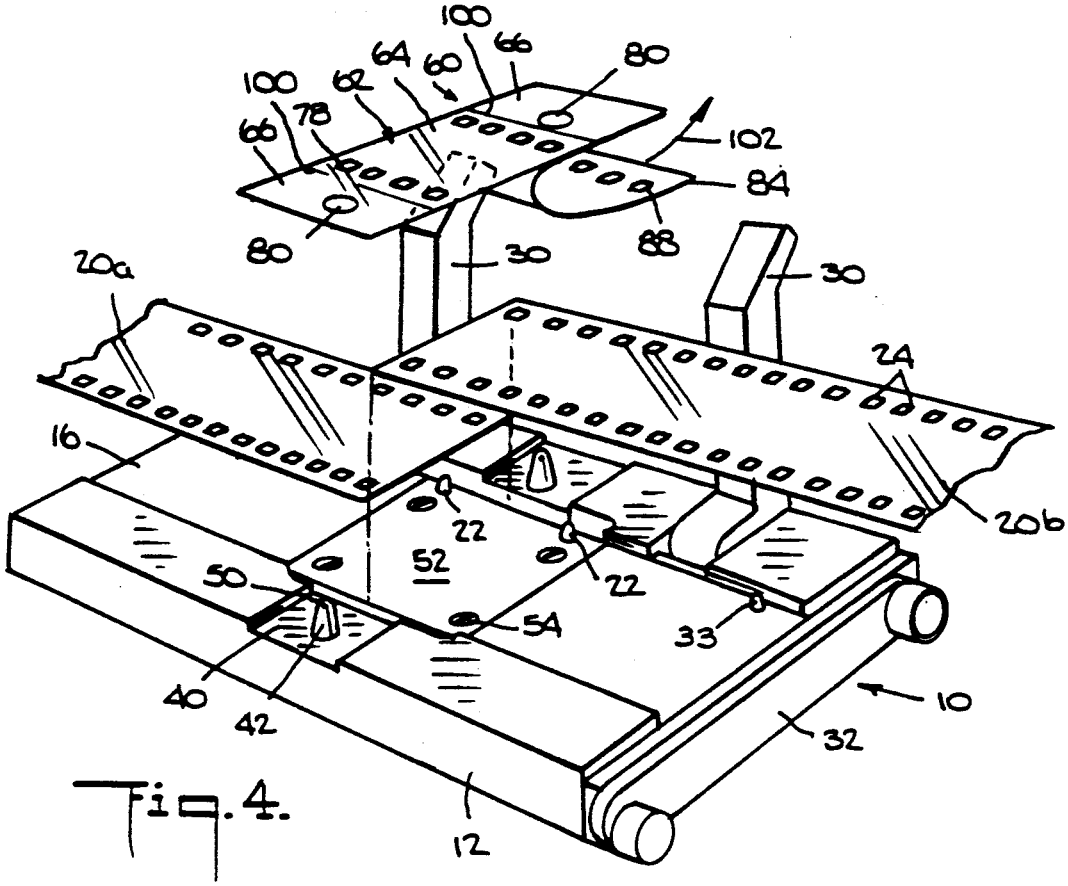
FIG. 4 is a fragmentary exploded isometric view of the jig, the film segments, and a portion of the film patch about to be applied to the film segments.

As is further conventional, optionally a film cutting knife 32 is pivotally connected at 34 to the jig body 12 and has a handle 36 at the other end. When it is necessary to trim a film segment and provide a clean film edge for mating with another film edge, the knife 32 is pivoted upwardly (as shown in FIG. 3), the film segment is placed in the longitudinal channel 16, and the raised knife 32 is lowered in the direction of arrow 38 (as shown in FIG. 4) to thereby cut the film and leave it with the desired edge. An auxilliary sprocket lug 33, similar to sprocket lugs 22, appropriately positions the film segment to be cut by entering one of its sprocket holes 24.

The jig 10 of the present invention differs from conventional jigs in three major respects. First, in addition to the longitudinal channel 16, there is a transverse channel 40. The transverse channel 40 is transverse to and interrupted by the longitudinal channel 16. It is disposed intermediate the two lever arms 30, and, more specifically, intermediate a pair of adjacent sprocket lugs 22, preferably equidistantly therefrom. The transverse channel 40 is preferably shallower than the longitudinal channel 16, but only slightly. Second, an alignment and tensioning lug 42 is upstanding from each end portion of the transverse channel 40, spaced outwardly from the respective adjacent longitudinal edge of the longitudinal channel 16 and inwardly from the side edges of the housing 12. The lugs 42 are preferably laterally aligned—that is, define a straight line perpendicular to the axis of the longitudinal channel 16 and thus to any film segments 20*a*, 20*b* disposed in the longitudinal channel 16. The lugs 42 are preferably in the form of a truncated cone, as are the sprocket lugs 22, and are preferably configured and dimensioned so that they cannot accidentally enter into a film sprocket hole 24. Third, the jig 10 defines, adjacent each intersection of a longitudinal edge of the longitudinal channel 16 and the transverse channel 40, a longitudinally extending groove or recess 50 having a depth greater than either channel 16, 40. Each recess 50 is relatively narrow, is disposed just outwardly of the longitudinal channel 16, and preferably extends longitudinally slightly beyond each side of the transverse channel 40.

The functions of the transverse channel 40, the aligning and tensioning lugs 42, and the recesses 50 will become apparent hereinafter.

Referring now in particular to FIGS. 4 and 11, to facilitate production of the jig 10, the jig housing 12 may be formed with the longitudinal channel 16 having a central portion intermediate recesses 50 at a greater depth (corresponding to that desired for the recesses 50) and an enlarged width relative to the end portions of longitudinal channel 16. A plate of hard metal 52 having a width equal to that of the longitudinal channel end portions is then positioned in the deepened and widened central portion of the longitudinal channel 16 and secured by screws 54 to the jig housing 12 so as to form with the end portions of the longitudinal channel 16 thereabout a continuous planar upper surface. The longitudinal sides of the plate 52 and the adjacent surfaces of the jig housing 12 define the recesses 50. A further advantage of this construction is that when the plate 52 become worn through use, it is easily replaced without replacement of the entire jig 10.

Figure 2:
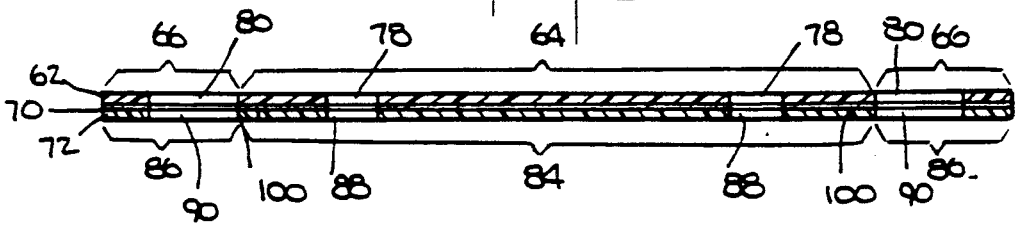
FIG. 2 is a sectional view thereof taken along the line 2—2 FIG. 1.

Referring now in particular to FIGS. 1 and 2, therein illustrated is a film splicing patch or splice, generally designated 60, according to the present invention. The patch 60 is used to attach two film segments 20*a*, 20*b* held in end-to-end abutting relationship in a splicer jig 10 as described above. The patch 60 is comprised of three layers—namely, a transparent strip generally designated 62 having a central portion 64 and an edge portion 66 on each side of the strip central portion 64, a layer 70 of transparent pressure-sensitive adhesive extending across the undersurface of the strip central portion 64 and preferably across the undersurface of the entire transparent strip 62 (as illustrated), and a liner 72 releasably adhered to and covering the undersurface of the adhesive layer 70.

More particularly, the strip 62 of transparent material has its central portion 64 configured and dimensioned to overlie the width of the adjacent ends of both film segments 20*a*, 20*b* and each of its edge portions 66 configured and dimensioned to extend widthwise beyond a respective longitudinal edge of the adjacent ends of the film segments 20*a*, 20*b*, when the strip 62 overlies the film segments 20*a*, 20*b*, as best shown in FIG. 5. The strip central portion 64 has longitudinally spaced sprocket holes 78 along at least one longitudinal edge thereof (as illustrated, along both edges), adapted to be aligned with the film sprocket holes 24, and each strip edge portion 66 has an alignment and tensioning aperture 80 therein configured and dimensioned to receive a respective alignment and tensioning lug 42 of the jig 10 when the transparent strip 62 is placed over the film segments 20*a*, 20*b* in the jig 10 (as illustrated in FIG. 4) and the edge portions 66 thereof pressed downwardly so that the alignment and tensioning lugs 42 substantially completely enter the apertures 80 (as shown in FIGS. 5 and 6). In this position, the transparent strip 62 is accurately positioned across the film segments 20*a*, 20*b* in the jig 10 to effect a vertical alignment of the strip sprocket holes 78 and the film sprocket holes 24 even though the jig sprocket lugs 22 do not enter the strip sprocket holes 78. Because the jig sprocket lugs 22 do not enter the strip sprocket holes 78, the jig sprocket lugs 22 cannot become fouled with adhesive residue from the adhesive layers 70 on the undersurface of the strip 62.

Figure 13:
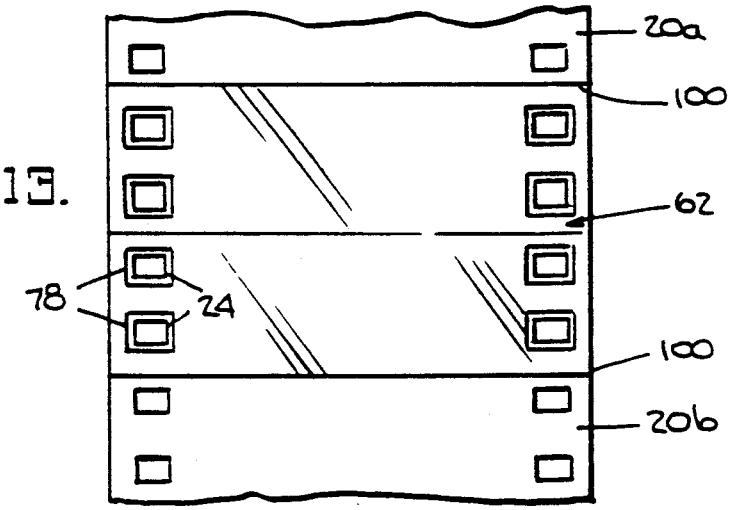
FIG. 13 is a top plan view thereof.

As best seen in FIG. 13 where the transparent strip 62 is illustrated in its final position atop the film segments 20*a*, 20*b*, the strip sprocket holes 78 are greater in both length and width than the film sprocket holes 24, so that the jig sprocket lugs 22 cannot introduce adhesive residue from the adhesive layer 70 under the transparent strip 62 into the film sprocket holes 24. The strip alignment and tensioning apertures 80 are in a lateral relationship similar to that of the alignment and tensioning lugs 42 of the jig 10, both the apertures 80 and lugs 42 preferably being disposed along an axis transverse to the longitudinal axis.

The transparent strip 62 may be formed of any of the thin, transparent, flexible, substantially non-stretchable (along the longitudinal axis) materials which are used for the transparent strip of a conventional film splice, except that the strip material must be slightly stretchable along the width axis (transverse to the longitudinal axis) for reasons which will become apparent hereinafter. A polyester strip material is preferred.

The adhesive layer 70 may be formed of any of the transparent pressure-sensitive adhesives of the type conventionally used in film splices. An acrylic adhesive is preferred. The adhesive layer 70 extends across at least the full width of the strip central portion 64 and preferably out to the far edges of the strip edge portions 66—that is, preferably fully across the undersurface of the transparent strip 62.

In order to inexpensively facilitate location of the splice rapidly and accurately when the time comes to remove the splice (e.g., for return of the film to the distributor in reels), a portion of the patch which remains on the film segments 20*a*, 20*b* after application of the patch to the film segments may contain a fluorescent dye which will be easily detectable under special illumination but invisible under ordinary illumination of the type used in motion picture film projection. Thus, the dye is contained either in the adhesive layer 70 or the strip central portion 64, preferably in the adhesive layer 70. Such fluorescent dyes are typically not visible to the human eye under illumination in the visible range, but visible to the human eye under a special light such as ultraviolet or infrared.

The releasable liner 72 adhered to and covering the undersurface of the adhesive layer 70 may be formed of a releasable liner material of the type conventionally used in film splices or to releasably cover other pressure-sensitive adhesive surfaces, and is preferably (although not necessarily) non-transparent. The liner 72 is divided into three portions, like the transparent strip 62, a central portion 84 and an edge portion 86 on each side of the liner central portion 84. The liner central portion 84 preferably, but not necessarily, has longitudinally spaced sprocket holes 88 vertically aligned with the sprocket holes 78 of the stripped central portion 64, and each of the liner edge portions 86 has an aperture 90 therein vertically aligned with a respective alignment and tensioning aperture 80 of the strip edge portion 66 thereabove. The apertures 80, 90 of the strip edge portions 66 and the liner edge portions 86, respectively, are preferably identically dimensioned; similarly, the sprocket holes 78, 88 of the strip central portion 64 and the liner central portion 84, respectively, are preferably identically dimensioned, with both sprocket holes 78, 88 being oversized relative to the film sprocket holes 24.

A line of severance 100 (for example, a nicked or perforated line) exists between the liner central portion 84 and each liner edge portion 86 to facilitate separation of the liner central portion 84 from the remainder of the splicing patch 60 prior to application of the patch 60 to the film segments 20*a*, 20*b*. Removal of the liner central portion 84 exposes the undersurface of the adhesive layer 70 for adherence to the upper surface of the film segments 20*a*, 20*b* (such removal being indicated in FIG. 4 by the arrow 102). Preferably the liner central portion 84 and the liner edge portions 86 are three individual and separate pieces so that the lines of severance 100 are not just lines of potential separability, but lines of actual separation between separate and distinct entities (although the adjacent edges of the entities may be in partial or full contact all or part of the time prior to use, possibly depending on the planarity of the flexible patch 60).

Referring now in particular to FIGS. 4–6, the vertically aligned apertures 80, 90 on one set of edge portions 66, 86 are spaced upon from the vertically aligned apertures 80, 90 of the other set of edge portions 66, 86 such that when the patch 60 (minus the already removed liner central portion 84) is positioned over the alignment and tensioning lugs 42 of jig 10 (as illustrated in FIG. 4) and the edge portions 66, 86 are pressed downwardly, so that the lugs 42 fully enter the apertures 80, 90 and the bottom of the liner edge portions 86 are resting on the upper surface of the transverse channel 40, the strip central portion 64 and its underlying adhesive layer 70 are slightly spaced above the film segments 20*a*, 20*b* (e.g., by about 25 mm.). Thus, the interaction of the alignment and tensioning lugs 42 and the alignment and tensioning apertures 80, 90 not only aligns the sprocket holes 78, 88 of the strip 62 and liner 72 with the sprocket holes 24 of the film segments 20*a*, 20*b*, but also tensions the strip 62 widthwise so as to normally maintain the strip central portion 64 and its underlying adhesive layer 70 spaced slightly above the film segments 20*a*, 20*b*.

Referring now in particular to FIG. 7, once the patch 60 and the film segments 20*a*, 20*b* are appropriately positioned on the jig 10, a slight downward pressure is exerted on the full width of the strip central portion 64, e.g., by the finger 110. While finger pressure may be used, preferably a clean, non-scratching material or tool is employed between the finger 110 and the transparent strip 62 to prevent scratching, smudging or staining of upper surface of the strip 62. The finger or implement may be moved back and forth along the width axis as necessary to insure full contact between the adhesive layer 70 underlying the strip central portion 64 and the upper surface of the film segments 20*a*, 20*b*. Because the jig 10 holds the adhesive layer 70 in very close proximity to, although not in actual contact with, the upper surface of the film segments 20*a*, 20*b*, the small amount of air therebetween can easily escape as the transparent strip 62 is depressed further toward the film segments so that no air bubbles are formed between strip central portion 64 and the film segments 20*a*, 20*b*. Additionally, the maintenance of the transparent strip 62 under tension essentially eliminates the possibility of the strip becoming creased during its application to the film segments. Furthermore, the liner edge portions 86 are typically less flexible than the strip edge portions 66 and therefore assist in maintaining the strip 62 crease-free and its central portion 64 suspended over the ends of the film segments 20*a*, 20*b*. As noted above, the transparent strip 62 is at least slightly stretchable along the width or transverse axis so that, when downward finger pressure is applied to the top of the central portion 64 thereof while the edge portions 66 thereof are immobilized by the jig alignment and tensioning lugs 42 (as illustrated in FIG. 7), the strip 62 can stretch widthwise sufficiently to enable physical contact to be made between the adhesive layer 70 directly underneath the strip central portion 64 and the film segments 20*a*, 20*b* thereunder (typically a gap of only about 25 mm).

Referring now to FIG. 8, therein illustrated is the composite assembly of patch 60 (minus the liner central portion 84) and the film segments 20*a*, 20*b* after its removal from the jig. The assembly is next inverted so that the bottom layer is the transparent strip 62, the intermediate layer is the adhesive layer 70, and the top layer is formed by the film segments 20*a*, 20*b* and the liner edge portions 86 (the latter not being visible in this view).

Referring now to FIG. 9, the inverted composite assembly of FIG. 8 is returned to the jig 10 with the alignment and tensioning lugs 42 again entering the apertures 80, 90 and the exposed surface of the strip central portion 64 now contacting the longitudinal channel 16 of housing 12 (or more particularly, the plate 52 thereof). The film segments 20*a*, 20*b* are also disposed in the longitudinal channel 16, still slightly below the housing top surface 14. At this point, a new patch 60', with its liner central portion removed, is placed on the jig 10 in the same manner as the previous patch 60, the adhesive layer under the strip central portion of the new patch 60' being maintained slightly spaced above the exposed upper surface of the film segments 20*a*, 20*b* as a result of the tensioning of the new patch 60' by the aligning and tensioning lugs 42. Then finger pressure is applied downwardly to the central portion of the new patch 60' to cause the adhesive layer thereof to secure together the film segments 20*a*, 20*b* and the strip central portion of the new patch 60'.

It will be appreciated that at this time there is about each alignment and tension lug 42 a sandwich comprised of, from the bottom up, the strip edge portion 66, the adhesive layer 70 and the liner edge portion 86 of the old patch 60 and the liner edge portion, the adhesive layer, and the strip edge portion of the new patch 60'. (This is not a laminate as there is nothing binding together the liner edge portions of the two patches 60, 60'.) On the other hand, the two film segments 20*a*, 20*b* are joined both below and on top by the adhesive layer and strip central portion of the old patch 60 and new patch 60', respectively.

Referring now to FIG. 10, a knife 112 or other cutting implement is then drawn through the composite assembly and downwardly into a recess 50 adjacent each of the alignment and tensioning lugs 42 in turn, thereby to sever each strip edge portion and its underlying adhesive from the strip central portion of each patch 60, 60' along the longitudinal edge of the film. The recesses 50 are disposed in respective parallel vertical planes adjacent respective longitudinal edges of the film segments 20*a*, 20*b* and serve as cutting guides so that the strip central portions may be severed from the strip edge portions along predetermined lines, both without cutting of the longitudinal film edges and without leaving any unsevered portion of the patches extending outwardly beyond the longitudinal film edges. After this has been done on both longitudinal sides, the portions of the composite assemblies adjacent the alignment and tensioning lugs 42 are removed and discarded.

Only the knife or cutting tool 112 and the film segments 20*a*, 20*b* are brought into any contact with the adhesive layer 70 of the patch. The knife or cutting tool 112 is, of course, easily cleanable to remove adhesive residues therefrom, for example, by a solvent bath. As earlier noted, the sprocket holes 78, 88 of the patch central portions are enlarged relative to the film sprocket holes 24 so as to preclude the jig sprocket lugs 22 from transferring any adhesive residues from the adhesive layer 70 into the film sprocket holes 24.

Referring now to FIGS. 11 and 12, the retaining means 30 are raised, and the now spliced film segments 20*a*, 20*b*, with the aligned strip central portions of patches 60, 60' adhered thereto by portions of the adhesive layer, are removed from the jig 10.

If desired, both patches 60, 60' may incorporate a fluorescent dye of the type described earlier, although in fact only one need incorporate such a fluorescent dye in order to enable rapid and accurate location of the splice thereafter. It will be appreciated that only temporary splices (which are intended to be subsequently removed) should be made with patches containing fluorescent dye, while the permanent patches used to repair accidentally torn film and the like should not incorporate the fluorescent dye, so that a quick scan of the film in a dark room will reveal only those splices which should be removed to put the film into suitable condition for return to the distributor.

Figure 14:
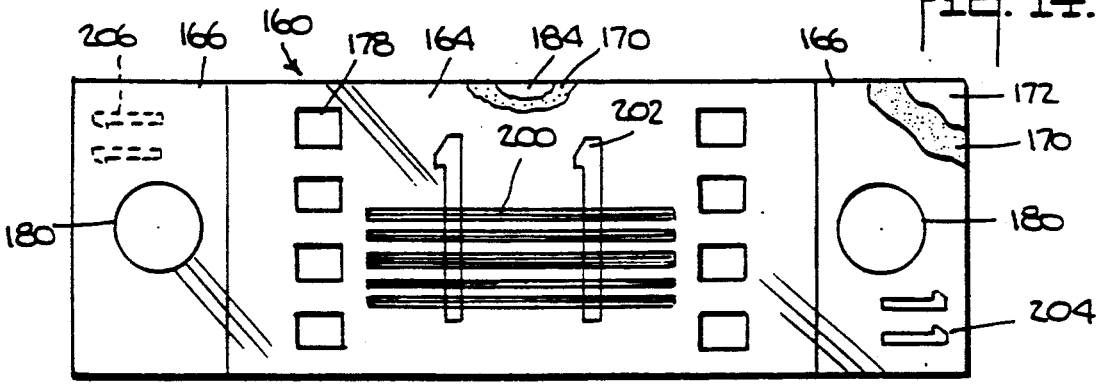
FIG. 14 is a top plan view of a film patch according to the present invention.

Referring now to FIG. 14, therein illustrated is a control patch generally designated 160 and generally similar to the splicing patch 60, but containing a first material which is transparent under ordinary light but machine-readable under special conditions, e.g., under a first special light. More particularly, the first material may be an infrared reflective material which is transparent under the illumination typically used to project a motion picture film, but readable under infrared light. The first material may be any of the well-known materials which are transparent or invisible under ordinary light, but machine-readable under light of a different spectrum. A portion of the first material is preferably arranged to provide information or data relative to one of the film segments 20*a*, 20*b* (such as a need to raise or lower a curtain at the beginning or end of a presentation, change a projector lens, to raise or lower house lights, or the like). Elements of the control patch 160 similar in structure or function to elements of the splicing patch 60 are indicated by corresponding reference numerals in the 100 series begin with 160.

The information- or data-providing portion is preferably presented in at least two forms, one a machine-readable form, such as the bar codes 200, and one a human-intelligible form, such as the number 202 (in the form of the numeral 11). The data or information provided in the human-intelligible form 202 is either directly or symbolically related to the data or information provided in the machine-readable form 200. Clearly, other machine-readable forms other than bar codes may be used—e.g., transparent magnetic strips—and similarly human-intelligible forms other than numbers may be used.

While the information or data-providing portions in machine-readable form and in human-intelligible form may merely be different portions of the same first material, in a preferred embodiment the portion in machine-readable form and the portion in human-intelligible form are formed of different materials—one being a first material as described above and the other being a second material which is also transparent under ordinary light but visible to the human eye under a second special light different from the first special light, with the first material being transparent to the machine in the second special light and the second material being transparent to the human eye in the first special light. In this case, depending upon whether the first special light or the second special light is used, only the machine-readable form (such as the bar code 200) or only the human-intelligible form (such as the number 202) will be detected. Of course, if both special lights are used simultaneously, then both will be detectable. The use of different materials which are visible or detectable under different special lights enables the best special light to be used for machine-reading and the best special light to be used for human-reading.

In order to facilitate selection of the appropriate control patch 160 for application to particular film segments, data or information directly or symbolically related to that provided by the first or second materials on the transparent strip central portion 164 may also be imprinted on the patch 160 in indicia visible under ordinary light. This enables the control strip 160 to be selected and applied (in the same manner as the splicing patch 60) under ordinary light—that is, without any special light. Such indicia may be located either on a strip edge portion 166 as indicated by the number 11 in solid line at 204 or on a visible surface of the releasable liner 172 as indicated by the number 11 in dotted line at 206. As illustrated in FIG. 14, a combination of the two indicia is used, the strip edge portion 166 on the right containing the indicia at 204 in visible ink and the liner edge portion 186 on the left also containing the indicia at 206 in visible ink. While the indicia at 206 on the liner edge portion 186 is illustrated as being on the upper surface thereof (so that it is visible through the transparent strip edge portion 166), clearly it may also be placed on the liner central portion 184 or the lower surface of the liner 172. As the strip edge portion 166 and the complete liner 172 will be removed during the splicing operation, the presence of the indicia in visible ink thereon does not interfere with projection of the film.

The present invention also encompasses a control strip similar to control strip 160 except that it is not designed to splice film and hence may be considerably smaller and simpler. Thus, the modified control strip (not shown) may be shorter and narrower, with a width such that it fits between the longitudinal rows of the film sprocket holes 24. Such a modified control strip would require neither strip or liner edge portions 66, 86, nor strip or liner sprocket holes 78, 88. Accordingly, the modified control strip is simply comprised of an imperforate transparent strip having a transparent pressure-sensitive adhesive on one side thereof for adhering the transparent strip to a length of a motion picture film and optionally a releasable liner, the control strip additionally including at least a first material which is transparent under ordinary light but visible or readable under special conditions, e.g., under a special light. The modified control strip may be applied manually or using a conventional jig.

To effect a splice, the ends of the film segments 20*a*, 20*b* which are to be spliced are trimmed to an appropriate length using the cutting knife 32 and then placed in end-to-end abutting relationship within the longitudinal channel 16 of the jig 10, with the jig sprocket lugs 22 entering appropriate sprocket holes 24 of the film segments. The lever arms 30 are then lowered to maintain the film segments in place within the longitudinal channel 16. Next, an appropriate splicing patch 60 is selected, its liner central portion 84 is removed, and the patch apertures 80, 90 of the strip and liner edge portions 66, 86 are placed over the alignment and tensioning lugs 42 of the transverse channel 40. Downward pressure is then applied to the strip edge portions 66 to cause the alignment and tensioning lugs 42 to enter fully into the patch apertures 80, 90, thereby positioning the strip sprocket holes 78 appropriately relative to the film sprocket holes 24, and tensioning the patch 60 so that the adhesive layer 70 thereof is just slightly spaced above the film segment ends to be joined. Next, downward pressure on the strip central portion 64 causes the adhesive layer 70 under the strip central portion 64 to adhere to the film segment ends, after which the lever arms 30 are raised, and the composite assembly of the film segments 20*a*, 20*b* and the patch 60 are then inverted and returned to the longitudinal channel 16. At this point, the lever arms 30 are again lowered, a new splicing patch 60 has its liner central portion removed, its edge portions are disposed on the alignment and tensioning lugs 42 and, finally, its strip central portion is depressed to cause adhesion thereof to the film segment ends. Finally, a cutting tool 112 is inserted through the composite assembly (now composed of the film segments 20*a*, 20*b* and the two patches 60, 60') and into the recesses 50, first on one side of the film segments and then on the other side of the film segments, to separate the composite assembly (now composed of the film segments 20*a*, 20*b* and the strip central portions) from the strip and liner end portions. The latter are discarded, and the spliced film segments are ready for use.

Essentially the same procedure is employed in affixing the control patch 160 to a film, except that, unless the control patch is also to serve as a splicing patch, it is simply a length of film rather than two film segments which are placed in the longitudinal channel 16, and it is only necessary that one control patch be applied to one surface of the film (rather than a pair of splicing patches applied to both surfaces of the film segments). Selection of the appropriate control patch may be effected in ordinary light, relying on the indicia visible to the human eye either on the liner at 206 or on the strip edge portion at 204. Alternatively, the patch may be applied in a special light, relying on the special indicia at 202 on the strip central portion 164 visible under that special light.

It will be appreciated that in the jig 10 the longitudinal channel 16 and the sprocket lugs 22 upstanding therefrom in combination comprise means for receiving the pair of film segments 20*a*, 20*b* to be spliced together in end-to-end abutting relationship and maintaining the film segments in such end-to-end abutting relationship when appropriate sprocket holes 24 of the film segments are placed on respective sprocket lugs 22. In the jig 10 described hereinabove, only one sprocket lug 22 need enter a sprocket hole 24 of each film segment 20*a*, 20*b* in order to maintain the film segments in the desired relationship—that is, there need be only two sprocket lugs 22, one for each film segment 20*a*, 20*b*. The sprocket lugs 22 maintain the desired longitudinal spacing between the sprocket holes 24 of the film segments, while the longitudinal channel 16 serves to maintain the film segments therein in the desired longitudinal alignment. Clearly one can dispense with the longitudinal channel 16 by modifying the jig to provide for each film segment at least a longitudinally spaced pair of sprocket lugs 22, instead of just one sprocket lug 22. In this variant, the sprocket lugs 22 not only maintain the appropriate longitudinal spacing of the film sprocket holes 24, but also maintain the film segments 20*a*, 20*b* in the desired longitudinal alignment.

Referring now to FIGS. 15 and 16, therein illustrated is a second embodiment 10' of the jig 10 useful only for film containing a transversely spaced pair of longitudinally spaced pluralities of sprocket holes 24 (that is, a longitudinally-extending row of sprocket holes adjacent each longitudinal side of the film). Elements of the second embodiment 10' which are structurally or functionally similarly to elements of the first embodiment 10 have been correspondingly numbered. In jig 10' the longitudinal channel 16 is dispensed with and a transversely spaced and aligned pair of sprocket lugs 22, 22' are employed for each film segment 20*a*, 20*b*, with the same intended effect of maintaining the film segments 20*a*, 20*b* in the desired longitudinal alignment. Of course, a longitudinal channel 16 may also be provided in the variant embodiment 10', if desired.

It will also be appreciated that the transverse channel 40 of the jig 10 described hereinabove may, like the longitudinal channel 16, be dispensed with. In the second embodiment 10', instead of relying upon the combination of the transverse channel 40 and alignment and tensioning lugs 42 to position the patch 60, 160 closely adjacent to, but slightly spaced above, the film segments 20*a*, 20*b*, the transverse channel 40 is dispensed with and the generally conical alignment and tensioning lugs 42 are each provided with a flared base 220 adjacent the housing top surface 14. The flared bases 220 limit downward movement of the patch edge portions 66, 86 on the alignment and tensioning lugs 42 so as to appropriately position the patch, and in particular the strip central portion 64 and underlying adhesive central portion 84, relative to the film segments 20*a*, 20*b*. Accordingly, the housing top surface 14 adjacent the splicing area is generally planar except for the groves 50, the sprocket lugs 22, 22', and the alignment and tensioning lugs 42—that is, there is neither a longitudinal channel 16 nor a transverse channel 40. If desired, a cutaway 222 for a finger may be provided in the housing top surface 14 laterally outwardly of at least one of the tensioning lugs 42 in order to facilitate lifting and removal of an overlying portion of the film patch 60, 160 (more specifically, a composite including a strip edge portion 66 and a liner edge portion 86) from the jig housing 12. Clearly the cutaway 222 is neither necessary nor desirable where the composite of the strip edge portion 66 and liner edge portion 86 would overhang a side of the housing 12.

While a strictly conical configuration of the alignment and tensioning lugs 42 could be used to appropriate position the patch 60, 160 relative to the film segments 20*a*, 20*b*, the use of stop means adjacent the base of the lugs 42 is preferred. The stop means enable the patch 60, 160 to be easily and rapidly positioned and pressed downwardly onto the lugs 42 and into the desired position closely above the film segments without danger of the patch being pushed too far down and contacting the film segments prematurely, as might be the case if the strip and liner apertures 80, 90 were not dimensionally stable and might expand to allow downward movement of the strip and liner edge portions 66, 86 further than intended. The desired stop function is performed in the first embodiment of jig 10 by the transverse channel 40 and in the second embodiment of jig 10' by the flared base 220 of each alignment and tensioning lug 42.

To summarize, the present invention provides a film splicing patch which is rapidly and accurately applicable to motion picture film without creasing of the patch, without the formation of air bubbles intermediate the patch and the film, and without introducing adhesive residue into the films pocket holes or onto the jig. The film splicing patch is not manifested itself on the screen and does not interfere with the sound track, yet can manifest its location on the film under special conditions so that it can be easily and rapidly detected to facilitate removal of the splicing from the film at a suitable time. The film splicing patch can additionally function as a control patch containing machine-readable information for control functions readable under special conditions, and may optionally also contain related information in human-intelligible form which is readable under special lighting conditions, which may be different from the special conditions required for the machine-readable information. Finally, the present invention provides a jig for use in applying such a splicing or control patch to a film and a method of splicing utilizing such a jig and the splicing patch.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the present invention.

I claim:

1. A film patch for attachment to a film segment having sprocket holes longitudinally spaced along at least one longitudinal edge thereof and adapted to be held in a jig, said film patch comprising:

(A) a strip of transparent material having a central portion and an edge portion on each side of said strip central portion, said strip central portion being configured and dimensioned to overlie the width of the film segment and each of said strip edge portions being configured and dimensioned to extend widthwise beyond a respective longitudinal edge of the film segment when said strip overlies the film, said strip central portion having longitudinally spaced sprocket holes for alignment with the film sprocket holes and each said strip edge portion having an alignment aperture therein for accurately positioning said strip across the film segment in the jig to effect vertical alignment of said strip sprocket holes and the film sprocket holes;

(B) a layer of transparent pressure-sensitive adhesive containing a fluorescent dye extending across the undersurface of at least said strip central portion; and (C) a releasable liner adhered to and covering at least the undersurface of said adhesive layer.

2. The patch of claim 1 wherein said strip alignment apertures are laterally aligned.

3. The patch of claim 1 wherein said strip is flexible, substantially non-stretchable along the longitudinal axis, and slightly stretchable along the width axis.

4. The patch of claim 1 wherein said liner has a releasable central portion and an edge portion on each side thereof, said liner central portion having longitudinally spaced sprocket holes aligned with said strip central portion sprocket holes.

5. The patch of claim 4 wherein said strip and liner sprocket holes are greater in length and width than the film sprocket holes.

6. The patch of claim 1 wherein said adhesive layer extends fully across the undersurface of said strip, and said liner has a releasable central portion and an edge portion on each side of said liner central portion, each of said liner edge portions having an alignment aperture therein aligned with a respective strip alignment aperture, said liner additionally defining a line of severance intermediate said liner central portion and each of said liner edge portions.

7. The patch of claim 6 wherein said liner central portion and said liner edge portions are three individual and separate pieces.

8. The patch of claim 1 wherein a portion of said patch remaining after release and removal of said liner and removal of said strip edge portions contains an indicia defined by a first material transparent to the human eye under ordinary light.

9. The patch of claim 8 wherein said indicia contains a fluorescent dye.

10. The patch of claim 1 wherein a portion of said patch includes an indicia defined by a first material transparent to the human eye under ordinary light containing information relative to the film segment.

11. The patch of claim 10 wherein said information is in machine-readable form.

12. The patch of claim 8 wherein said liner includes indicia visible to the human eye under ordinary light related to the information or data provided on said patch by said first material.

13. The patch of claim 8 wherein at least a portion of said first material is a fluorescent dye incorporated into said adhesive layer.

14. The patch of claim 8 wherein said first material is visible under infrared light.

15. The patch of claim 8 wherein said patch additionally includes a second material which is also transparent to the human eye under ordinary light but visible to the human eye under a second special light.

16. The patch of claim 15 wherein at least a portion of said first material is arranged to provide information or data relative to one of the film segments, and at least a portion of said second material is arranged to provide information or data related to said information or data on said information- or data-providing portion of said first material.

17. The patch of claim 16 wherein said information- or data-providing portion of said first material is in machine-readable form and said information- or data-providing portion of said second material is in human-intelligible form.

18. The patch of claim 15 wherein said second material is different from said first material and said second material is visible to the human eye under said second special light which is different from a first special light, said first material being transparent to said second special light and said second material being transparent to said first special light.

19. The patch of claim 10 wherein at least one of said strip edge portions contains indicia visible under ordinary light for providing information or data related to said information or data provided by said first material.

20. A film patch for attachment to two film segments adapted to be held in end-to-end abutting relationship in a splicer jig and having sprocket holes longitudinally spaced along at least one longitudinal edge thereof, said patch comprising:

(A) a strip of transparent material having a central portion and an edge portion on each side of said strip central portion, said strip central portion being configured and dimensioned to overlie the width of both film segments and each of said strip edge portions being configured and dimensioned to extend widthwise beyond a respective longitudinal edge of both film segments, when said strip overlies the film, said strip central portion having longitudinally spaced sprocket holes aligned with the film sprocket holes and each said strip edge portion having an alignment aperture therein for accurately positioning said strip across the film segments in the jig to effect vertical alignment of said strip sprocket holes and the film sprocket holes; said strip being flexible, substantially non-stretchable along the longitudinal axis and slightly stretchable along the width axis, said strip alignment apertures being laterally aligned;

(B) a layer of transparent pressure-sensitive adhesive containing a fluorescent dye extending fully across the undersurface of said strip; and (C) a releasable liner adhered to and covering the undersurface of said adhesive layer, said liner having a releasable central portion with longitudinally spaced sprocket holes aligned with said strip central portion sprocket holes and an edge portion on each side of said liner central portion, with an alignment aperture therein aligned with a respective strip alignment aperture, said strip and liner sprocket holes being of greater dimensions than the film sprocket holes, and said liner defining a line of severance intermediate said liner central portion and each of said liner edge portions.

21. The patch of claim 20 additionally including a first material which is transparent to the human eye under ordinary light but detectable by a machine and a second material which is also transparent to the human eye under ordinary light but visible to the human eye under a second special light, at least a portion of said first material being arranged to provide information in machine-readable form relative to one of the film segments, and at least a portion of said second material being arranged to provide information in human intelligible form related to said information on said information providing portion of said first material.

22. The patch of claim 21 wherein said second material is different from said first material and said second material is visible to the human eye under said second special light which is different from a first special light, said first material being transparent to the second special light and said second material being transparent to said first special light.

23. In combination, a motion picture film and a control strip adhered thereto, said control strip comprising a transparent strip having a transparent pressure-sensitive adhesive on one side thereof adhering said transparent strip to a length of said film, said control strip additionally including a first fluorescent dye material which is transparent under ordinary light but machine-readable under a first special light.

24. In combination, a motion picture film and a control strip adhered thereto, said control strip comprising an imperforate transparent strip having a transparent pressure-sensitive adhesive on one side thereof adhering said transparent strip to a length of said film, said control strip additionally including a first fluorescent dye material which is transparent under ordinary light but visible under a first special light and a second material which is also transparent under ordinary light but visible under a second special light; at least a portion of said first material being arranged to provide information or data in machine-readable form relative to said film length and at least a portion of said second material being arranged to provide information or data in human intelligible form related to said information or data on said information- or data-providing portion of said first material, said second material being different from said first material and visible under a second special light different from the first special light, said first material being transparent to the second special light and said second material being transparent to the first special light.

* * * * *